US008647459B2

(12) United States Patent
Spatafora

(10) Patent No.: US 8,647,459 B2
(45) Date of Patent: Feb. 11, 2014

(54) METHOD AND EQUIPMENT FOR PREPARING AND APPLYING FOLDED LEAFLETS

(75) Inventor: Mario Spatafora, Granarolo (IT)

(73) Assignee: G.D S.p.A. (IT)

( * ) Notice: Subject to any disclaimer, the term of this patent is extended or adjusted under 35 U.S.C. 154(b) by 514 days.

(21) Appl. No.: 12/815,770

(22) Filed: Jun. 15, 2010

(65) Prior Publication Data

US 2011/0002754 A1 Jan. 6, 2011

(30) Foreign Application Priority Data

Jul. 1, 2009 (IT) ..... BO2009A0425

(51) Int. Cl.
*B29C 53/02* (2006.01)

(52) U.S. Cl.
USPC ..... 156/204; 156/64; 156/226; 156/227; 156/184

(58) Field of Classification Search
USPC ..... 156/64, 204, 226, 227, 443, 459, 184; 493/68, 69; 206/242, 273
See application file for complete search history.

(56) References Cited

U.S. PATENT DOCUMENTS 4,832,783 A * 5/1989 Nechay et al. ..... 156/448
5,250,134 A 10/1993 Thomas et al.
6,506,275 B1 * 1/2003 Vijuk et al. ..... 156/227
2009/0084503 A1 4/2009 Kobayashi
2009/0260640 A1 * 10/2009 Campagnoli et al. ..... 131/58

FOREIGN PATENT DOCUMENTS

| | | |
|---|---|---|
| EP | 1599386 | 11/2005 |
| GB | 2293817 | 4/1996 |
| WO | 9638365 | 12/1996 |
| WO | 2004076322 | 9/2004 |
| WO | 2008035224 | 3/2008 |

OTHER PUBLICATIONS

European Search Report dated Jun. 16, 2010 from counterpart Italian application.

* cited by examiner

*Primary Examiner* — George Koch
(74) *Attorney, Agent, or Firm* — Timothy J. Klima; Shuttleworth & Ingersoll, PLC

(57) ABSTRACT

A method of preparing and applying folded leaflets or coupons to packets in a cigarette packer includes the steps of cutting single leaflets from a continuous strip material, scoring them with transverse crease lines and then causing each one to wrap around one of a set of winding members operating in conjunction with a fixed restraint; a leading portion of the leaflet is taken up by the winding member, which is then set in rotation while also revolving in close proximity to the restraint, in such a way as to bend the leaflet along the crease lines and form a succession of folds.

15 Claims, 4 Drawing Sheets

METHOD AND EQUIPMENT FOR PREPARING AND APPLYING FOLDED LEAFLETS

This application claims priority to Italian Patent Application BO2009A000425 filed Jul. 1, 2009, the entirety of which is incorporated by reference herein.

BACKGROUND OF THE INVENTION

The present invention relates to a method of preparing and applying folded leaflets, and to equipment capable of implementing such a method, intended particularly for use in machines for packaging consumer products, typically packets of cigarettes and the like.

It is the conventional practice for certain consumer products such as packets of cigarettes to include coupons or leaflets, folded at least twice and printed with information about the particular product and/or with other sales information of whatever nature.

In the case of cigarette packets, in particular, these folded leaflets are positioned generally between the packet and an overwrapping film of transparent flexible material, in such a way as to remain visible throughout the distribution and shelf life of the unopened packet. To this end, the folded leaflets are applied generally to packets of cigarettes, typically to the rear face of the packet, before the selfsame packets are overwrapped in the transparent film material.

The prior art embraces equipment for applying folded leaflets to packets of cigarettes, designed to operate either using leaflets procured already cut and folded, taken one by one from a stack, or by cutting the single leaflets in-process from a roll of previously folded strip material.

Patent application EP 1599386 discloses a machine for folding and applying coupons or 'onserts' to consumer products, such as packets of cigarettes, utilizing a continuous roll of preprinted coupons and a transverse cutter assembly by which the continuous material is divided up into single coupon segments. Each segment comprises a pair of preprinted coupons positioned side by side. Each of the segments in turn is received by a folder mechanism and bent double along at least one transverse fold line. The folded coupon segment is then divided by a longitudinal cutter assembly into two individual coupons, or onserts. A transport system receives the folded coupons singly in succession and moves them along dual diverging paths, whereupon they are taken up by a pair of lug belt conveyors, spaced apart one from another, at the discharge end of the transport system. Each lug belt conveyor presents transverse lugs spaced apart equidistantly along its developable length, against which the coupons are positioned. The coupons are transferred from the conveyors by a pair of applicator wheels, spaced apart one from another, onto consumer products spaced apart and travelling past the applicator wheels.

Prior art solutions in this field do not fully meet the needs of manufacturers, particularly with regard to their utilization on packaging machines in service today, capable of operating at notably high production speeds.

One drawback, in particular, is that the level of precision required for the step of folding the leaflets cannot be guaranteed. To ensure optimum presentation of the product to the consumer, in effect, it is important that the folded portions of the leaflet bent double one over the other should be perfectly aligned.

The object of the present invention is to overcome the problems aforementioned, providing a method by which folded leaflets can be formed and applied to consumer products, typically packets of cigarettes and the like, in machines utilized for packaging the products in question.

A further object of the present invention is to provide equipment for preparing and applying folded leaflets designed to implement the method disclosed, and designed in particular for use in conjunction with packaging machines capable of high operating speeds.

Another object of the invention is to provide equipment for preparing and applying folded leaflets, such as will enable a high level of precision when folding the selfsame leaflets.

Yet another object of the invention is to provide equipment characterized by simple design, in terms of construction and operation, such as will be dependable, versatile, and relatively inexpensive to carry into effect.

SUMMARY OF THE INVENTION

The stated objects are realized, according to the present invention, in a method and equipment for preparing and applying folded leaflets as recited in the claims appended.

A method according to the present invention for preparing and applying folded leaflets in packaging machines includes the steps of cutting single leaflets from a strip material, scoring at least one transverse crease line on each leaflet, then wrapping the leaflets around respective winding members by setting each winding member in rotation relative to the leaflet and thus bending the leaflet along the at least one transverse crease line to produce at least two longitudinally ordered folds.

In a preferred embodiment of the invention, the winding members consist in elements of biconvex profile, each rotatable about a median axis parallel to the at least one transverse crease line presented by the leaflets. The biconvexly profiled element is designed to take up and retain a portion of the leaflet to be folded along the at least one transverse crease line.

The present invention relates similarly to equipment for preparing and applying folded leaflets, which comprises a rotatable folding head carrying a plurality of angularly spaced peripheral winding members, each designed to take up, retain and thereupon substantially wrap itself in a single leaflet. The winding members are set in rotation individually while revolving simultaneously and synchronously with the folding head. During the winding step, a free trailing portion of the leaflet bears against fixed restraint means in such a way that the leaflet is forced to wrap around the winding member, bending along at least one transverse crease presented by the selfsame leaflet.

BRIEF DESCRIPTION OF THE DRAWINGS

A preferred embodiment of the invention will now be described in detail, by way of example, with the aid of the accompanying drawings, in which.

DESCRIPTION OF THE PREFERRED EMBODIMENTS

Figure 1:
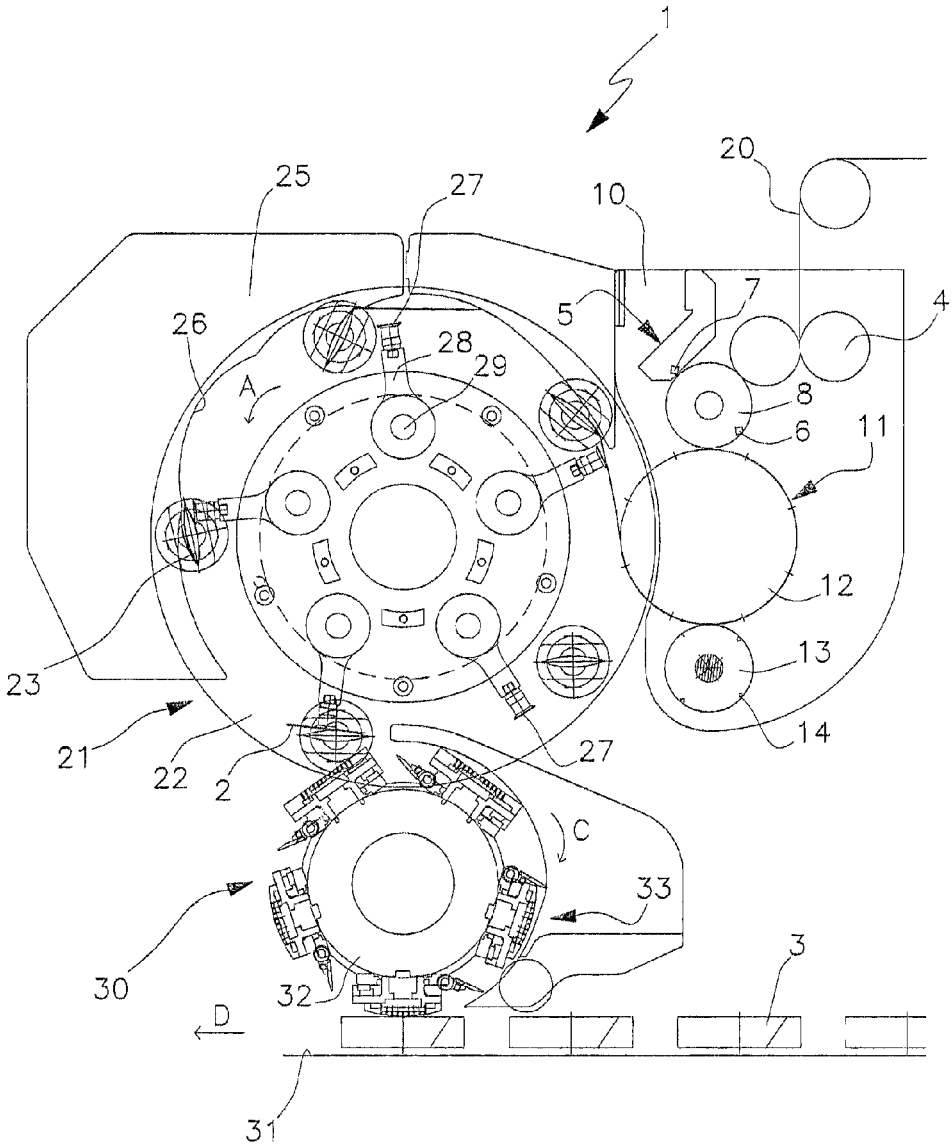
FIG. 1 is a front elevation view of equipment according to the invention for preparing and applying folded leaflets.

With reference to the accompanying drawings, numeral 1 denotes equipment, in its entirety, for preparing and applying folded leaflets 2; more specifically, such equipment is intended for use in packaging machines turning out packets 3 of cigarettes or the like.

The leaflets 2 are obtainable from a continuous strip 20 of sheet material, decoiling from a roll and directed along a curvilinear feed path by a set of continuously driven pinch rollers 4. The strip 20 of sheet material is fed to a cutting unit 5 by which successive transverse strokes are made through the selfsame strip 20 to produce a succession of single leaflets 2. The cutting unit 5 comprises a rotary blade denoted 6, designed to operate in conjunction with a fixed blade 7 anchored rigidly to the structure 10 of the equipment. The rotary blade 6 is carried by a disc 8 set in rotation about a substantially horizontal axis. The rotating disc 8 is furnished advantageously with a set of ducts emerging at the peripheral surface and connectable with vacuum means, in such a way that a degree of suction can be generated on the selfsame peripheral surface.

Located downstream of the cutting unit 5, along the feed direction followed by the leaflets 2, is a scoring unit 11 designed to impress a succession of transverse crease lines on the selfsame leaflets 2. These creases serve to define respective folds, or folded portions, ordered longitudinally along each leaflet 2. The scoring unit 11 comprises a pair of counter-rotating rollers 12 and 13 turning on axes parallel to the axis of the rotating disc 8 of the cutter unit 5. The peripheral speed of the two rollers 12 and 13 is identical, with the result that their relative angular velocity is zero at the point of tangency. More exactly, the scoring unit 11 comprises a first transport roller 12 on which the leaflets 2 advance, revolving substantially tangential and counter to the disc 8 of the cutting unit 5, and a second scoring roller 13 furnished peripherally with a plurality of blades 14, suitably spaced apart, by which the aforementioned crease lines are impressed on the leaflets 2. The first transport roller 12 is equipped with a set of ducts emerging at the peripheral surface and connectable to vacuum means in such a way that a degree of suction can be generated on the selfsame peripheral surface.

Located downstream of the scoring unit 11, along the feed direction followed by the leaflets 2, is a device 21 by which the selfsame leaflets 2 are bent and folded along the aforementioned crease lines. The folding device 21 appears as a head 22 in the form of a disc rotatable, in the direction indicated by the arrow denoted A, about a substantially horizontal axis parallel to the axes of the rollers 12 and 13 of the scoring unit 11. The folding head 22 is equipped peripherally with a plurality of angularly spaced winding members 23 by which single leaflets 2 are taken up, retained and wrapped around a forming element so as to fashion the aforementioned folded portions. Each winding member 23 consists in an element of biconvex profile, mounted rotatably to a relative pivot 24 aligned on a median axis parallel to the axis of rotation of the folding head 22 and caused to rotate in a direction indicated by the arrow denoted B, synchronously with the rotation of the folding head 22. The single winding members 23 present at least one end furnished with a set of holes, not indicated in the drawings, connectable to vacuum means in such a way as to generate a degree of suction for the purpose of picking up and retaining the leaflets 2 being folded.

The winding members 23 are designed to operate in conjunction with a fixed restraint 25 appearing as a side wall placed around the folding head 22 and describing a circumferential arc that extends through approximately 180 degrees between a point at which the leaflets 2 are taken up from the scoring unit 11, and a point at which the folded leaflets 2 are released. The surface of the side wall 25 directed toward the folding head 22 is contoured with a series of recesses 26 defining the operating surface of the restraint, of which the curvature is matched substantially to the biconvex profile of the winding members 23. The side wall 25 is also connected to vacuum means in such a way that a gentle force of suction can be maintained at the aforementioned operating surface.

The folding head 22 also carries a plurality of suction cup grippers 27 each associated and revolving together with a respective winding member 23, by which the folded leaflets 2 are taken up from the selfsame wrapping mechanisms 23 at the aforementioned point of release. The suction cup grippers 27 are located each at the tip of a relative rod 28 mounted hingedly to the folding head 22 via a pivot 29 of which the axis is disposed parallel to the axis of rotation of the folding head 22. The rods 28 of the suction cup grippers 27 are thus pivotable toward and away from a position of radial alignment on the center of rotation of the folding head 22.

The winding members 23 are also capable of axial movement, induced by relative actuator means, in such a manner as to vacate the point of release at the moment when the folded leaflets 2 are transferred to the suction cup grippers 27.

Figure 6:
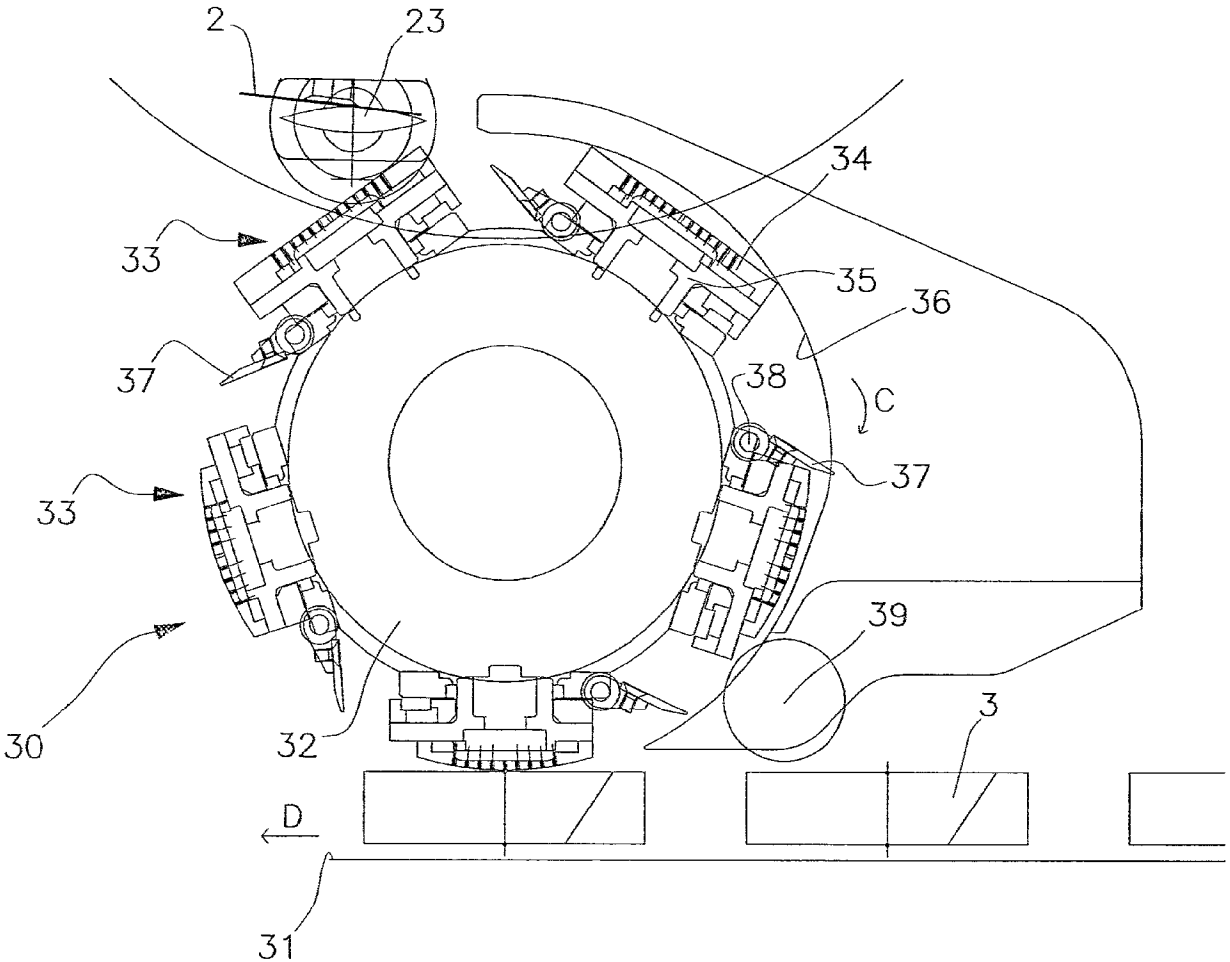
FIG. 6 is a front elevation view showing a distribution unit by which the folded leaflets are applied to consumer products.

Numeral 30 denotes a distribution unit located downstream of the folding device 21, by which the folded leaflets 2 are transferred to a conveyor 31 carrying packets 3 of cigarettes, forming part of the packaging machine and driven continuously in the direction of the arrow denoted D (FIG. 6). The distribution unit 30 comprises a wheel 32 set in rotation about an axis substantially parallel to the axis of the folding head 22, turning in a direction denoted C and synchronized appropriately with the rotation of the selfsame folding head 22.

The wheel 32 carries a plurality of transfer mechanisms 33 spaced angularly about its periphery, by which the folded leaflets 2 are received from the suction cup grippers 27 of the folding device 21 and applied to respective packets 3 of cigarettes each presenting a patch of suitable adhesive, applied previously.

The transfer mechanisms 33 consist essentially in a pick-up head 34 carried by the free end of a shaft 35, mounted rotatably about an axis disposed radially to the wheel 32. The pick-up head 34 is connectable to vacuum means in such a way that a suitable degree of suction can be generated through its top surface during the step of taking up and transferring the folded leaflets 2. The pick-up head 34 is pivotable through an angle of 90° by rotating the shaft 35, in such a way as to change the orientation of the folded leaflets 2 about to be applied to the packets 3 of cigarettes, and position the aforementioned crease lines longitudinally in relation to the packets 3.

During the step of transferring folded leaflets 2 from the folding device 21 to respective packets 3 of cigarettes, the selfsame leaflets 2 are engaged by a restraint 36 of arcuate geometry extending around the wheel 32. The function of the arcuate restraint 36 is to prevent the folded leaflets 2 from springing open. Also associated with each one of the transfer mechanisms 33 is an aligner element 37 consisting essentially in a finger, mounted hingedly to the wheel 32 following the pick-up head 34, relative to the direction C of rotation, and pivotable on a respective axis 38 parallel to the axis of the wheel 32. The aligner element 37 is caused by suitable fixed cam means (not illustrated) to describe an angular movement between a position of disengagement, and a raised operating position in which the finger locates against the edge of the leaflet 2 taken up by the pick-up head 34, so as to ensure that the selfsame leaflet 2 is correctly positioned.

Pressure means 39 stationed at the outfeed end of the arcuate restraint 36 serve to complete the operation whereby the leaflets 2 are folded up, and the folded portions matched together. Such pressure means 39 are embodied to advantage as a pair of pressure rollers positioned to engage the edges of the folded leaflet 2 and flatten the corresponding creases.

The manner in which folded leaflets are prepared and applied by the method according to the invention will be readily discernible from the foregoing description.

Individual leaflets 2 separated initially from the continuous strip 20 of sheet material by the cutting unit 5 are transferred to the scoring unit 11, which proceeds to generate a succession of transverse crease lines on the advancing leaflets 2. In practice, the crease lines are equal in number to the number of times the leaflets 2 will be bent double to produce the folded portions. Also, the folded portions may be of dissimilar dimensions, measured along the longitudinal axis of the leaflet 2, to suit different needs and preferences.

Figure 2:
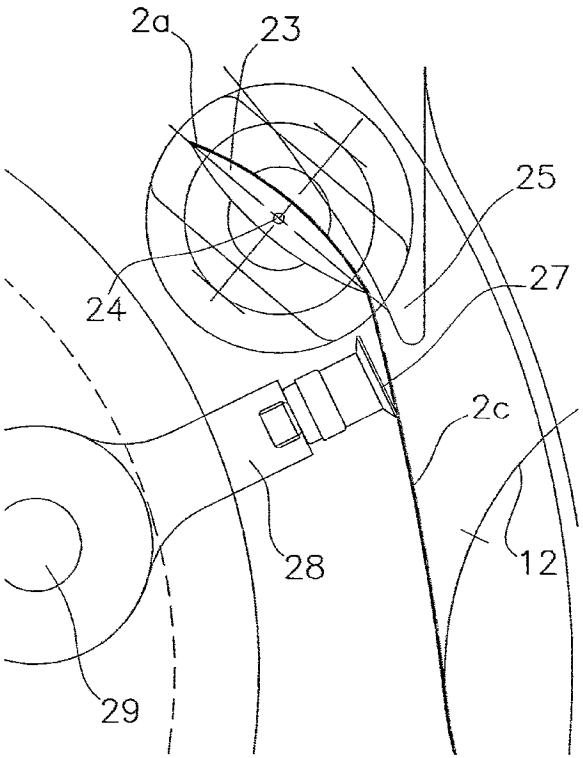
FIGS. 2 . . . 5 are front elevation views of a winding member forming part of the equipment, illustrated in successive operating steps.

Following the impression of the crease lines, the leaflets 2 are transferred in ordered sequence to the folding device 21, where each one undergoes a succession of bending operations as a result of which the folded portions, delimited by the aforementioned crease lines, are positioned one on top of another. To this end, a leading portion 2*a* of each leaflet 2 is first taken up by a respective winding member 23 revolving on the periphery of the folding head 22 (FIG. 2). In particular, the leading portion 2*a* of the leaflet 2 settles on the biconvex element of the winding member 23, occupying the convex surface directed away from the folding head. Retained in this position by suction generated through the holes in the winding member 23, the leaflet 2 is drawn gradually from the transport roller 12 of the scoring unit 11. Importantly, at the moment when the leading portion 2*a* of the leaflet 2 is taken up, the winding member 23 occupies a plane substantially tangential to the folding head 22, revolving in close proximity to the concave profile of the first recess 26 presented by the fixed side wall 25. Consequently, the trailing portion 2*c* of the leaflet 2 is separated from the transport roller 12 and drawn out under the side wall 25 (FIG. 2).

Figure 3:
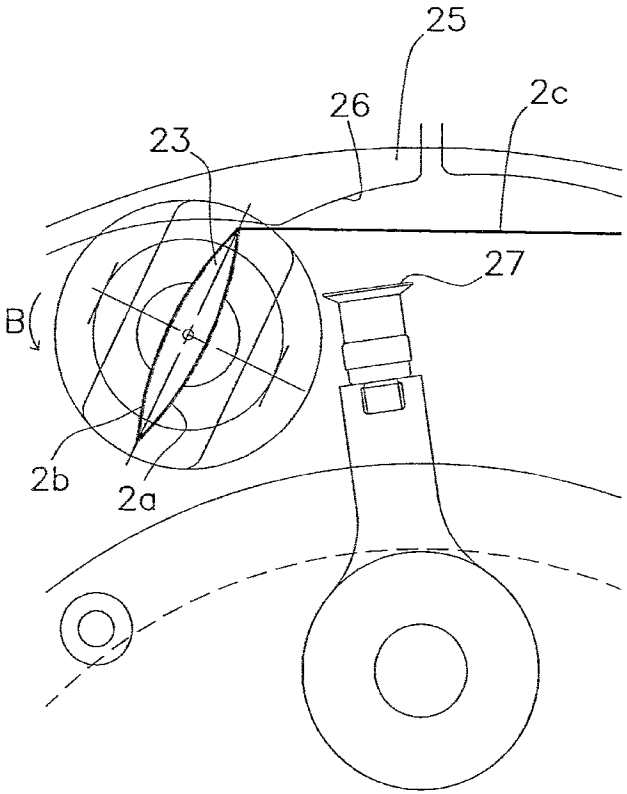

Once the leaflet 2 being folded has separated completely from the transport roller 12, the winding member 23 begins to rotate on the relative pivot 24, about its median axis. In essence, during this latter step, the movement of the winding member 23 is a combination of revolving motion induced by the rotation of the folding head 22, and axial rotation about the pivot 24, occurring simultaneously and in coordination. As the winding member 23 rotates about its axis, the advancing leaflet 2, constrained by the side wall 25, is forced to wrap around the selfsame winding member. The direction B of rotation of the winding member 23 and the direction A of rotation of the folding head 22 are concordant. In effect, the leaflet 2 is bent along a first crease line, causing a further portion 2*b* to settle on the convex surface of the biconvex element lying opposite from the surface occupied by the leading portion 2*a*, and at this stage of rotation directed away from the folding head 22 (FIG. 3). During this step, the trailing portion 2*c* of the leaflet 2 slides on the corresponding recess 26 of the side wall 25, retained by a gentle force of suction generated through the operating surface of the wall which, as afore-mentioned, is connected to vacuum means.

Figure 4:
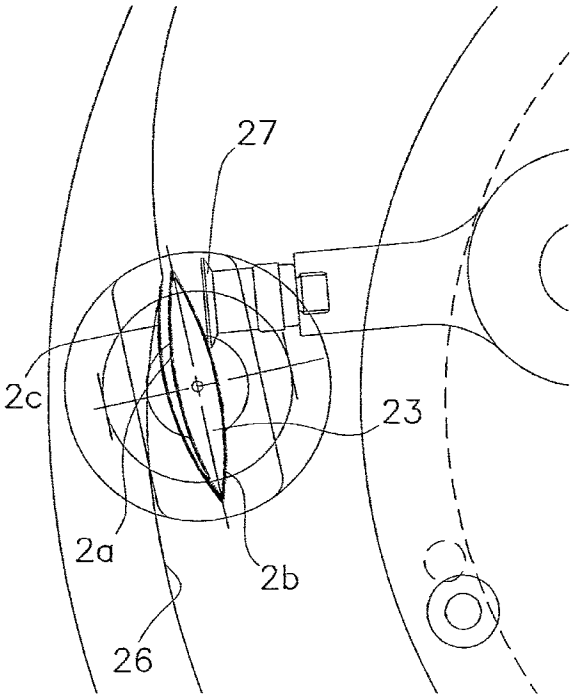

Importantly, the particular shape of the winding members 23, each presenting an element of biconvex geometry, is designed to ensure that the leaflet 2 bends faultlessly along the transverse crease lines. In effect, these same crease lines are positioned so as to coincide substantially with the two opposite edges of the winding members 23. Similarly, the effect of the winding action produced by the rotation of the winding member 23 on its axis is to fold the successive portions of the leaflet 2 by bending the leaflet along the respective crease lines (FIG. 4). In practice, the step whereby each portion of the leaflet 2 is folded over the next involves a rotation of the winding member 23 through 180°.

With the prescribed number of folds completed, the leaflet 2 will be taken up onto a relative suction cup gripper 27, positioned by a pivoting movement in such a way as to align with the winding member 23 around which the leaflet 2 is folded. The pivoting movement of the rod 28 causes the suction cup gripper 27 to engage the folded leaflet 2, still wrapped around the winding member (FIG. 4). At the same time as the folded leaflet 2 is taken up by the suction cup gripper 27, the winding member 23 will be translated axially in such a way as to free the folded leaflet 2 and vacate the point of release.

Figure 5:
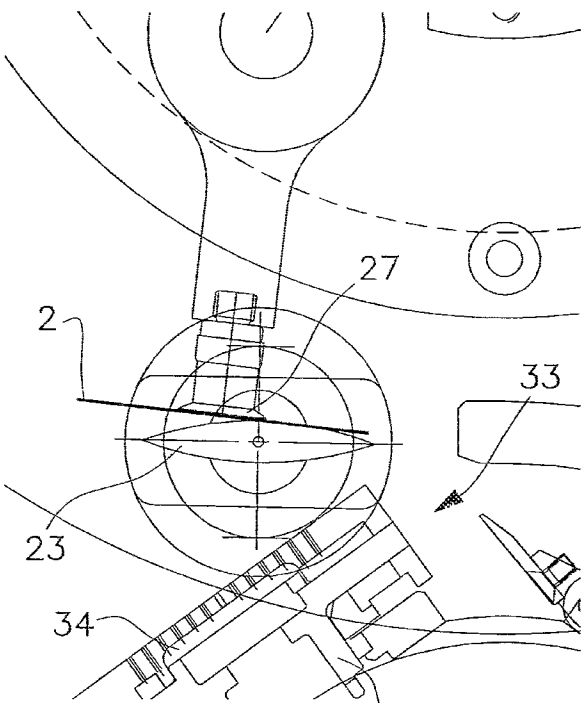

The folded leaflets 2 taken up by the suction cup grippers 27 are released to the distribution unit 30, and thereupon transferred by this same unit to the conveyor 31 on which the packets 3 of cigarettes advance (FIG. 5). To this end, the wheel 32 of the distribution unit 30 is set in rotation at a peripheral speed identical to that of the folding head 22, in such a way that the pick-up head 34 of each transfer mechanism 33 revolves neither faster nor slower than the respective suction cup gripper 27 carrying the folded leaflet 2 to be taken up by the head 34.

During the transfer step (FIG. 6), the single folded leaflets 2 are rotated through 90° into longitudinal alignment with the packets 3 of cigarettes advancing along the aforementioned conveyor 31 beneath, whereupon pressure is applied to the edges of each successive leaflet in such a way as to flatten and compact the folded portions together.

The object of optimizing the preparation of folded leaflets and their application to consumer products, in particular packets of cigarettes and the like, is duly achieved with the method and equipment disclosed, which are able to deliver a high level of precision in the operation of folding the leaflets.

This outcome is attributable essentially to the inventive step of preparing the folded leaflets by wrapping each individual leaflet around a relative winding member, in such a way that it is bent along previously scored crease lines to produce the requisite number of folded portions. The particular shape of the aforementioned winding member, presenting an element of biconvex geometry, is instrumental in ensuring that the leaflet will be folded faultlessly along the crease lines.

To particular advantage, the method and the equipment according to the invention can be employed to optimum effect in packaging machines capable of high operating speeds. More exactly, the leaflets are conveyed through the various operating steps using components by which they can be handled and transferred at high speed, retained where necessary through the agency of suction generated by suitable vacuum means.

The equipment described and illustrated by way of example might be embodied differently, according to particular requirements. For example, the crease lines could be scored in the material before the single leaflets are cut from the strip, and similarly, the steps by which the leaflets are wrapped around the winding members could be implemented differently. Moreover, the number and dimensions of the folded portions presented by the single leaflet might also be varied as appropriate.

Self-evidently, the winding members will be interchangeable according to the dimensions of the particular leaflets being folded.

What is claimed is:

1. A method of preparing and applying folded leaflets in packaging machines, including:

winding single leaflets, obtained from a strip material, around respective winding members each taking up and retaining a portion of a single leaflet while driven in rotation relative to a restraint mechanism acting on the single leaflets, to generate at least one fold in the single leaflet by bending the single leaflet around one of the respective winding members along at least one transverse crease line of the single leaflet;

providing each of the respective winding members with a portion having a biconvex geometry;

holding the folded single leaflet and removing the folded single leaflet from one of the respective winding members by axially withdrawing the one of the respective winding members from the folded single leaflet along a rotation axis of the one of the respective winding members.

2. The method as in claim 1, including:

feeding a continuous strip material into a cutting unit;

cutting the strip material transversely to obtain the single leaflets;

forming the at least one transverse crease line on each of the single leaflets, serving to delimit a plurality of folded portions ordered longitudinally along the single leaflet;

transferring at least one leading portion of the single leaflet to a respective winding member rotatable about an axis parallel to the transverse crease line;

setting the winding members in rotation relative to the restraint mechanism acting on the single leaflets, to wrap the single leaflets around the respective winding members by inducing a bend along the at least one transverse crease line of each single leaflet delimiting the longitudinally ordered folded portions;

taking up the folded single leaflets from the winding members and applying them to respective consumer products.

3. The method as in claim 2, wherein the wrapping the single leaflet around the respective winding member is accomplished by causing the respective winding member to have a revolving motion induced by rotation of a folding head to which the winding members are mounted, between a point at which the single leaflets to be folded are taken up and a point at which the folded single leaflets are released, combined simultaneously with rotation of the respective winding member about an axis parallel to the axis of rotation of the folding head, in a direction of rotation concordant with a direction of rotation of the folding head.

4. The method as in claim 3, wherein at least one trailing portion of the single leaflet is maintained in contact with the restraint mechanism during the wrapping the leaflet around the respective winding member.

5. The method as in claim 4, and further comprising providing that the restraint mechanism includes a side wall extending around the folding head on which the respective winding members are carried in rotation, forming a circumferential arc that extends between a point at which the single leaflets are taken up, and a point at which the folded single leaflets are released from the respective winding members.

6. The method as in claim 1, and further comprising providing that an edge of the portion having a biconvex geometry coincides with the transverse crease line of the single leaflet being folded to as the single leaflet is folded to bend the single leaflet along the transverse crease line.

7. The method as in claim 6, and further comprising providing each of the portions having biconvex geometry with a set of holes located near to at least one end and connectable to vacuum means, for picking up the leading portion of the single leaflet being folded.

8. The method as in claim 7, and further comprising holding the folded single leaflet and removing the folded single leaflet from the winding member by axially withdrawing the winding member from the folded single leaflet along the rotation axis of the winding member.

9. The method as in claim 8, and further comprising folding the single leaflet a plurality of times on the same respective winding member.

10. The method as in claim 9, and further comprising providing that the restraint mechanism includes a side wall extending around the folding head on which the respective winding members are carried in rotation, forming a circumferential arc that extends between a point at which the single leaflets are taken up, and a point at which the folded single leaflets are released from the respective winding members.

11. The method as in claim 10, and further comprising providing that a face of the side wall directed toward the folding head includes a contoured operating surface on which a gentle force of suction is maintained by connection to a vacuum source.

12. The method as in claim 10, and further comprising providing that a face of the side wall directed toward the folding head includes a contoured operating surface on which a force of suction is maintained by connection to a vacuum source.

13. The method as in claim 6, and further comprising holding the folded single leaflet and removing the folded single leaflet from the winding member by axially withdrawing the winding member from the folded single leaflet along the rotation axis of the winding member.

14. The method as in claim 6, and further comprising folding the single leaflet a plurality of times on the same respective winding member.

15. The method as in claim 1, and further comprising folding the single leaflet a plurality of times on the same respective winding member.

* * * * *